US008395039B2

(12) United States Patent
Steinhauser et al.

(10) Patent No.: US 8,395,039 B2
(45) Date of Patent: Mar. 12, 2013

(54) SNARE DRUM STAND WITH SELF-ADJUSTING BRACKET SIZE

(76) Inventors: Ruben Steinhauser, Altusried (DE); Winfried Holl, Illertissen-Au (DE)

( * ) Notice: Subject to any disclaimer, the term of this patent is extended or adjusted under 35 U.S.C. 154(b) by 266 days.

(21) Appl. No.: 12/847,697

(22) Filed: Jul. 30, 2010

(65) Prior Publication Data

US 2010/0313735 A1 Dec. 16, 2010

(30) Foreign Application Priority Data

Jun. 15, 2009 (DE) ..... 10 2009 024 909

(51) Int. Cl.
*G10D 13/02* (2006.01)

(52) U.S. Cl. ..... 84/411 R

(58) Field of Classification Search ..... 84/411 R, 84/421; 248/122.1, 123.11, 125.1, 125.2, 248/125.3, 125.7, 125.8, 125.9
See application file for complete search history.

(56) References Cited

U.S. PATENT DOCUMENTS

| | | | | |
|---|---|---|---|---|
| 3,405,587 | A | 10/1968 | Meazzi et al. | |
| 4,158,981 | A | 6/1979 | Kurosaki | |
| 5,331,878 | A | 7/1994 | Kurosaki | |
| 5,467,680 | A | 11/1995 | Kurosaki | |
| 5,645,253 | A | 7/1997 | Hoshino | |
| 6,384,308 | B1 | 5/2002 | Hoshino | |
| 6,723,907 | B2 | 4/2004 | Sato | |
| 7,087,827 | B2 | 8/2006 | Liao | |
| 7,205,469 | B2 * | 4/2007 | Chang | 84/421 |
| 7,365,257 | B2 | 4/2008 | Sato | |
| 7,557,284 | B2 | 7/2009 | Mori et al. | |
| 7,588,228 | B2 | 9/2009 | May | |
| 7,673,776 | B2 | 3/2010 | May | |
| 7,703,725 | B2 | 4/2010 | May | |
| 7,732,692 | B2 | 6/2010 | Mori et al. | |
| 7,741,551 | B2 | 6/2010 | Mori | |
| 2003/0126972 | A1 | 7/2003 | Sato | |
| 2005/0103184 | A1 * | 5/2005 | Hsieh | 84/421 |
| 2005/0274854 | A1 | 12/2005 | May | |
| 2006/0137507 | A1 | 6/2006 | Liao | |
| 2006/0174750 | A1 | 8/2006 | Chang | |
| 2007/0012160 | A1 | 1/2007 | Sato | |
| 2009/0007754 | A1 | 1/2009 | May | |
| 2009/0229444 | A1 | 9/2009 | Measelle | |
| 2009/0272250 | A1 | 11/2009 | Bassam | |
| 2010/0043622 | A1 | 2/2010 | Sandson | |
| 2010/0077903 | A1 | 4/2010 | Guager | |

FOREIGN PATENT DOCUMENTS

| | | |
|---|---|---|
| DE | 19501312 | 7/1996 |

* cited by examiner

*Primary Examiner* — Kimberly Lockett
(74) *Attorney, Agent, or Firm* — Dickinson Wright PLLC

(57) ABSTRACT

A snare drum stand with a snare drum bracket (5), wherein the snare drum bracket (5) comprises a plurality of interconnected bars (11, 12, 13, 14), which are movably coupled to one another, and having a snare drum bracket size being changeable by their connecting angle changeable with respect to each other, wherein an inclination of an end bar (14) is decoupled from an inner angle of a lower bar (11).

20 Claims, 4 Drawing Sheets

SNARE DRUM STAND WITH SELF-ADJUSTING BRACKET SIZE

CROSS REFERENCE TO RELATED APPLICATIONS

Figure 1:
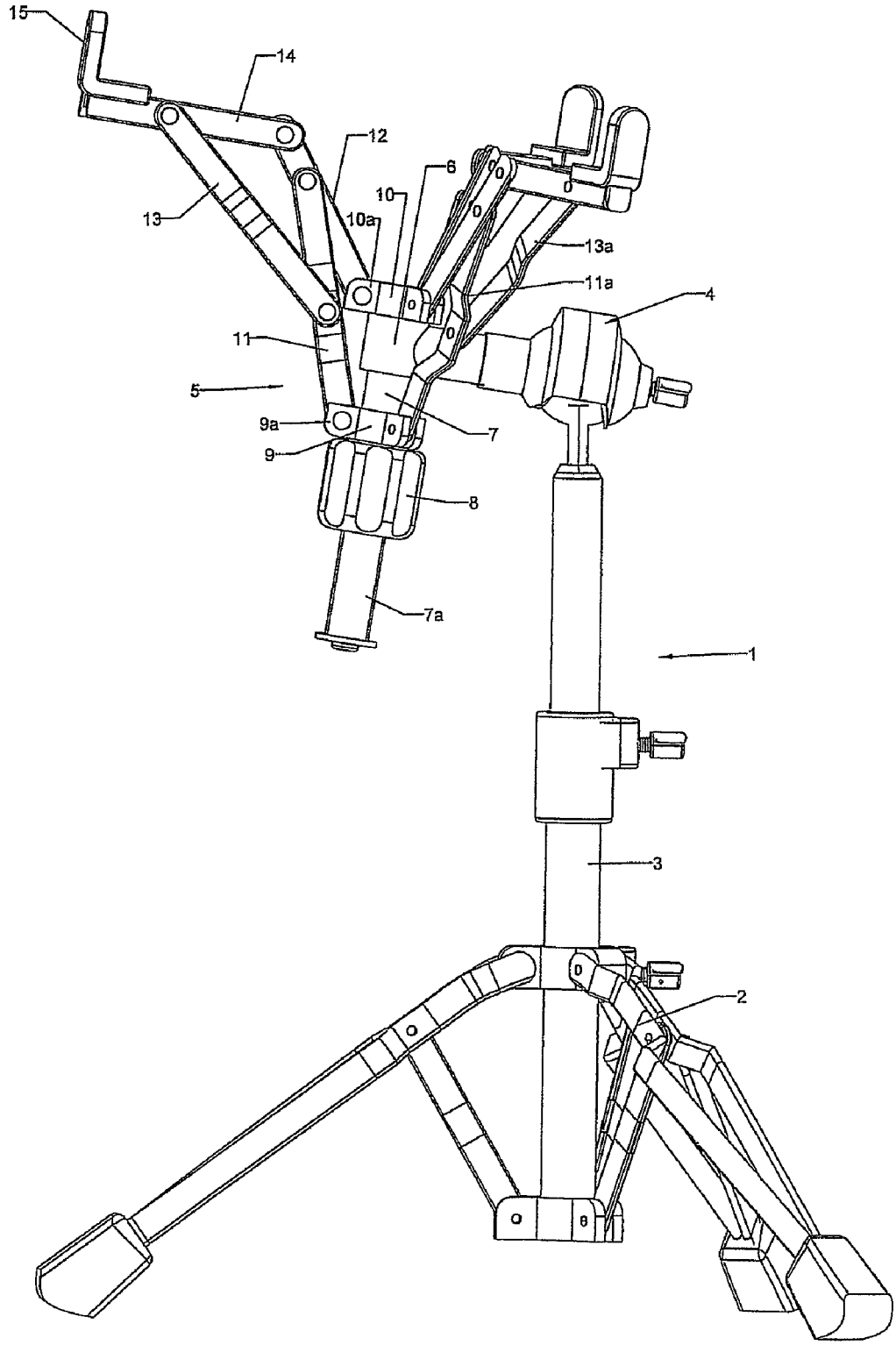

This application is related to, and claims the benefit of priority from, German Patent Application Ser. No. DE102009024909.5, filed Jun. 15, 2010, the disclosure of which is incorporated herein by reference in its entirety.

The present invention concerns a snare drum stand with self-adjusting bracket size.

In general, the design of musical instruments, particularly with regard to their shape and size, has a significant effect on the sound generated by the instruments. Thus, it can be easily understood that there exist instruments of similar type in many different size variants. This is also true for the field of drums and in particular also for snare drums.

Now, particularly for drums, it is a prevailing problem that during transport occasionally many components have to be considered, such as for example the different drums and their stands. Stands, which are designed for only one specific size of an instrument are therefore not desirable, if the user desires flexibility with regard to the instruments used. Furthermore, for the private use, it is a financial relief, if it is not required to also having to buy a new stand for each new instrument. Therefore, particularly in the field of drums, it is desirable, to use stands which are adjustable in size.

It is known from common snare drum stands, that they comprise a receiving bracket functioning for a specific diameter of the snare drum. Due to construction, a secure holding of the snare drum in the bracket can only be insured, if the diameter of the instrument does not under-run the predetermined diameter. If, for example, by the use of a smaller instrument this diameter is under-run, the bars of the bracket close too far, and the instrument is not safely mounted any more. Therefore, to adjust the mount to smaller instruments, bent bars are used for example to change the mounting angle. A further known way to be able to use smaller instruments is to adjust the bars individually to the respective mounting angle by means of an additional joint.

However, these approaches for solutions contain disadvantages. By using bent bars the bracket is adjusted to the size of small snare drums, whereby bigger instruments cannot be used any more. If further joints are introduced to adjust the bars to the mounting angle, the bracket has to be newly adjusted prior to use with each changing of an instrument, which is laborious and time-consuming.

It is therefore an object of the present invention to provide a snare drum stand suitable for use of a snare drum in a wide size region having a size adjustment of the bracket, which is easy and reliable.

This object is solved according to the invention by the snare drum stand according to patent claim 1. Further advantageous developments are subject to the dependent claims.

The advantages achieved with the invention in particular are that a snare drum stand comprises a snare drum bracket having a bracket mount assembled of a plurality of bars. The bars are arranged such that they are moveable with respect to each other, such that the size of the bracket for receiving a snare drum can be varied. As far as possible, this can be done without a changing of the receiving angle of a receiving part for the instrument. Thus, safe receiving of the instrument, independent on the bracket size, is insured. Therein, the bracket size can be changed easily, since the connecting angles of the bars can be varied with respect to each other. The bracket size essentially depends on an inner angle between a lower bar and a bracket support. By decoupling of the receiving angle from the bracket size, and thus from the inner angle, the use is possible in an extended size interval.

In an advantageous development of the invention, the bars are pivotally connected to each other. This allows easy handling when adjusting the size. Preferably, this connection is established by riveting. This involves the further advantage that the connections cannot loosen.

In a further advantageous development of the invention the bars are arranged such that the bracket size is achieved by simply sliding lower bar supports. Thus, a fast and uniform adaptation of the bracket size to the instrument is possible.

In a next advantageous development of the invention, fixing means for fixing the lower bar support are used. This conduces to reliability and a tight mounting of the instrument in the snare drum bracket. Preferably, the fixing means are formed as a screw nut. The screw nut is pivotally connected with the lower bar support and is in engagement with a thread portion of the bracket support. Thus, a reliable and easy size adjustment of the snare drum bracket is achieved by sliding of the lower bar support by means of the fixing means.

Figure 2:
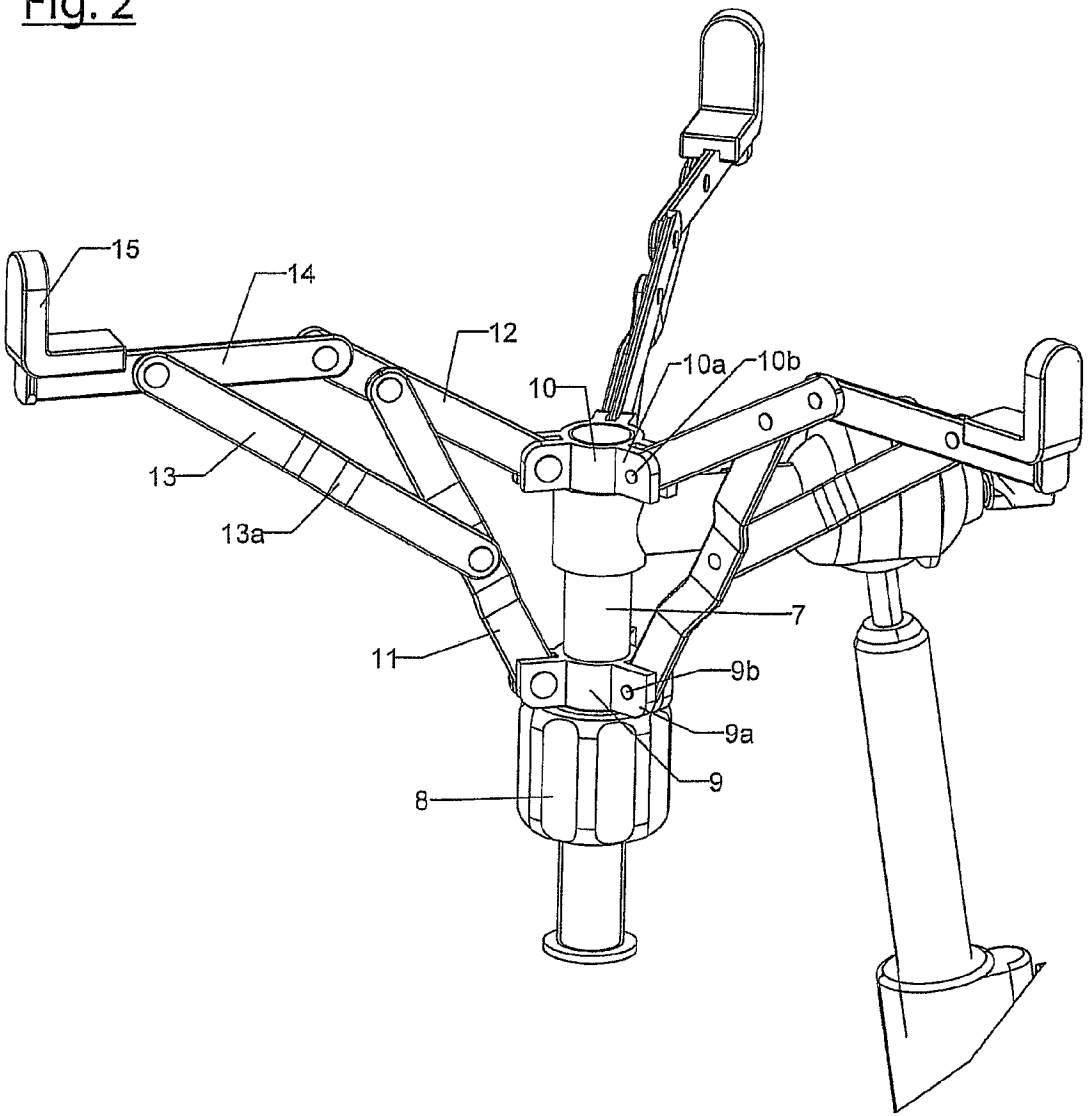
Figure 3:
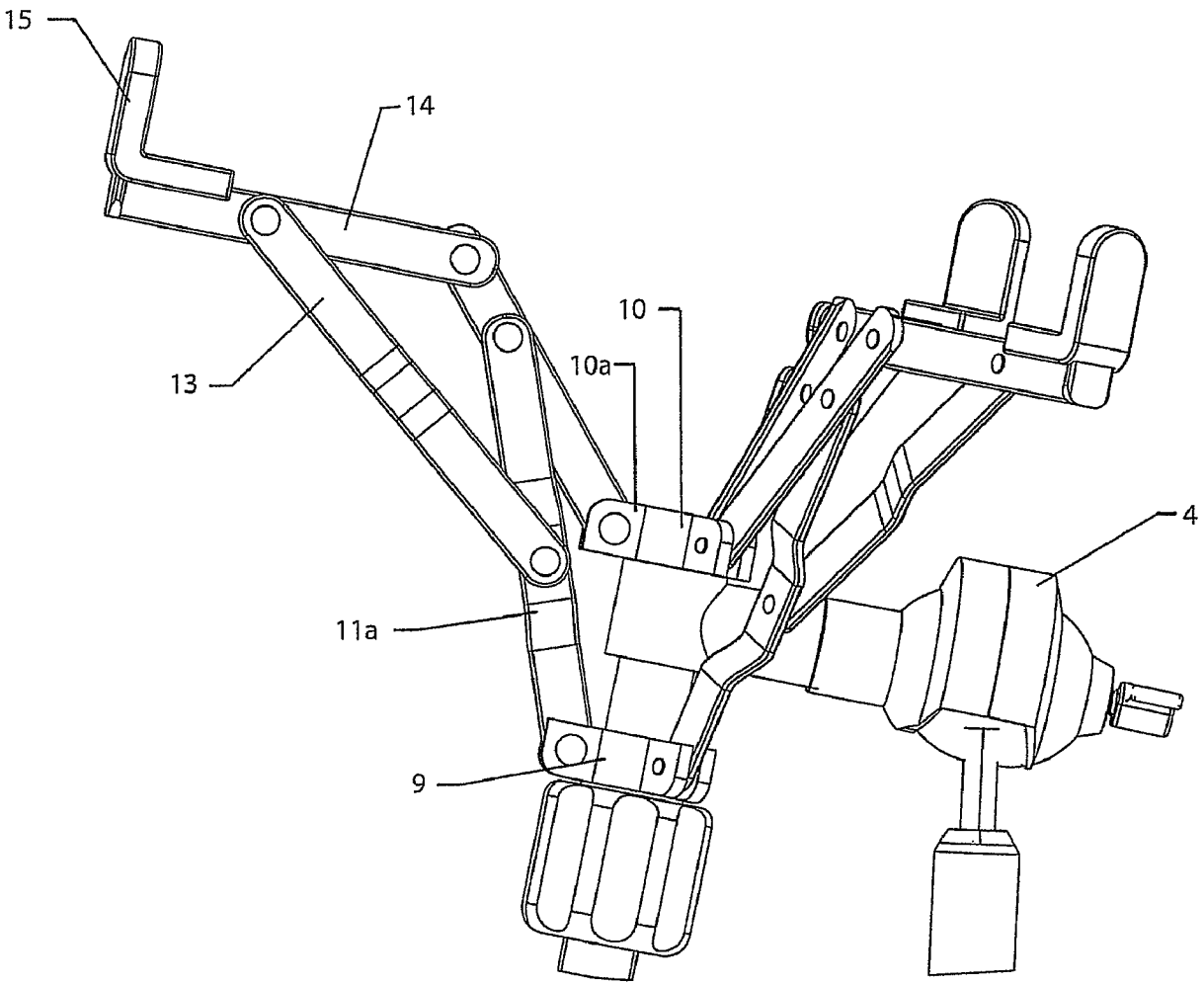
Figure 4:
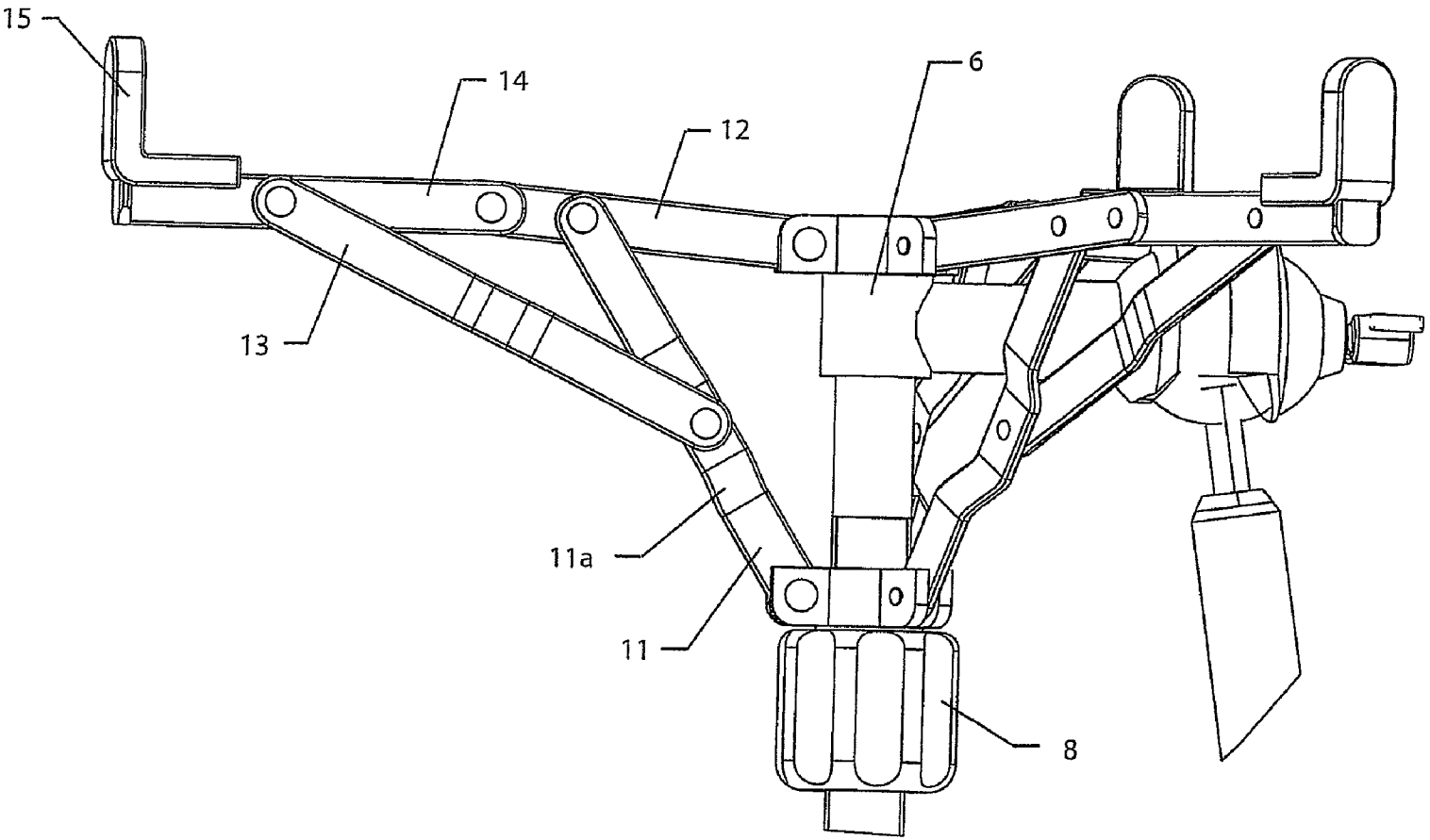

Details, advantages and further developments of the invention will be explained in more detail with the help of an embodiment with reference to the drawings. Therein show:

FIG. 1 a snare drum stand with snare drum bracket according to the invention;

FIG. 2 a snare drum bracket;

FIG. 3 a snare drum bracket for receiving a smaller instrument;

FIG. 4 the snare drum bracket of FIG. 3 for receiving a bigger instrument.

The illustration in FIG. 1 shows a preferred embodiment of a snare drum stand 1.

The snare drum stand 1 has a stand tripod 2, a stand column 3, a bracket mount 4 and a snare drum bracket 5. Bracket receiving means 6 extending from the bracket mount 4 toward the snare drum bracket receive a bracket support 7. For simplified description, in the following as a vertical direction pointing away from the stand tripod the denomination "up" and for a vertical direction pointing toward the stand tripod the denomination "down" is used. Therein, the snare drum bracket is arranged in an essentially vertical direction, regardless of it being able to be tilted around a horizontal axis.

The bracket support 7 essentially is a cylindrical rod having a thread portion 7*a*. The thread portion is formed from one end closer to a lower bar support 9 than an upper bar support 10 to a middle portion between the bar supports 9, 10.

Both, the lower bar support 9 and the upper bar support 10 comprise a plurality of receiving portions 9*a* and 10*a*, e.g., here three receiving portions. The receiving portions 9*a*, 10*a* are formed in regular portions, here having an angle of 120° with regard to each other. The receiving portions 9*a*, 10*a* are formed such that two parallel portions being formed spaced to each other extend radially outward, wherein the distance between the two portions enables for receiving lower bars 11 or upper bars 12. Furthermore, the receiving portions 9*a*, 10*a* are provided with holes 9*b*, 10*b* (FIG. 2) which are congruently arranged with corresponding holes at one end of the lower bar 11 or the upper bar 12. Thus, the lower bar support 9 and the upper bar support 10 can receive the lower bar 11 and the upper bar 12, respectively, and can be connected to it. In the preferred embodiment the connection is effected by riveting. Preferably, the riveted components are rotatable with respect to each other.

The upper bar support 10 is essentially formed as a cylinder barrel, from which the receiving portions 10*a* radially extend outward (FIG. 2). The inner radius of the upper bar support 10 corresponds to the radius of the bracket support 7. In the present embodiment the upper bar support 10 is arranged around the bracket support 7 such that a head side of the bracket support 7 is aligned to the edge of the upper bar support. The other edge of the upper bar support 10 being directed downward is aligned adjacently to the bracket receiving means 6 of the bracket mount 4. The bracket receiving means essentially are formed as a cylinder barrel having an inner radius corresponding to the radius of the bracket support 7. In the preferred embodiment, the upper bar support 10 is aligned fixedly in position.

The lower bar support 9 is essentially also formed as a cylinder barrel with an inner radius corresponding to the radius of the bracket support 7. In the embodiment shown here, the lower bar support 9 is connected with fixing means 8. The fixing means 8 can be formed as a screw nut, as in the present case. The screw nut is engaged with the thread portion 7*a* of the bracket support 7. The connection between the fixing means 8 and the lower bar support 9 is formed such that during rotation of the fixing means 8 the lower bar support 9 indeed slides along the bracket support 7, however, a rotation of the fixing means 8 is not transmitted to the lower bar support 9.

In the preferred embodiment, the fixing means 8 comprises portions formed at an outer surface thereof, which allow engagement with a suitable tool.

The lower bar 11 is formed as a long drawn-out rectangular plate having rounded corners. The length of the lower bar 11 therein is a multiple of its width. The width on the other hand is a multiple of the thickness of the lower bar 11. In the proximity of each of the two ends, the lower bar 11 comprises a hole for the connection with the lower bar support 9 on the one side, and for the connection with an upper bar 12 on the other side. Furthermore, the lower bar 11 is formed such that it comprises a contour 11*a* in a middle portion thereof. The contour extends in a direction perpendicular to the surface of the plate, from the surface in a direction not pointing to the side on which the upper bar 12 joins the lower bar 11 after their connection (FIG. 3). The contour 11*a* thus forms a recess of the surface of the plate, which resembles a U-profile in a horizontal sectional view. Furthermore, the contour 11*a* is formed with a hole, enabling a connection with a connecting bar 13.

As can be seen from FIG. 2, the connecting bar 13 has proportions similar to the lower bar 11. Further, the connecting bar 13 has a hole formed at both ends. In addition, the connecting bar 13 comprises a stepped profile, if viewed in a horizontal sectional view, in a portion facing the lower bar 11. The step 13*a* is formed such that it corresponds with the contour 11*a* of the lower bar 11, such that respective holes of the connecting bar 13 and the lower bar 11 can be arranged congruently. At the second end of the connecting bar 13, the hole for a connection with an end bar 14 is provided, which will be described later.

The upper bar 12 essentially has the same dimensions as the lower bar 11. The upper bar 12 has a hole formed at each of the ends. A connection with the upper bar support is provided at the end facing the bracket support 7. A connection with the end bar 14 is provided at the second end averting the bracket support 7. In a middle portion, on the side averting the bracket support 7, a further hole is formed for connecting with the lower bar 11. The upper bar 12 extends in an angle with respect to an axis of the bracket support 7 being flatter than an angle of the lower bar 11 with respect to the axis of the bracket support 7.

According to FIG. 2, the end bar 14 essentially comprises the same dimensions as the lower bar 11. A hole is formed at one end of the end bar 14 being provided for a connection with the upper bar 12. In a medium portion a further hole is formed in the end bar 14, provided for a connection with the connecting bar 13. Furthermore, the free end of the end bar 14, that is the end averting the bracket support 7, is formed in a T-shape. Thus, the free end forms a flat rest. In a portion of the free end of the end bar 14, a receiving part 15 is provided on the rest of the end bar 14.

In a vertical sectional view, the receiving part 15 is formed in an L-shape and is provided on the rest of the end bar 14. The receiving part 15 is arranged on the end bar 14 such that it is open in an upwardly directed direction and in a direction facing the bracket support 7. The receiving part 15 preferably is formed of resin. In other embodiments, also further materials, such as wood or metal for example, can be conceived.

The lower bar 11, the upper bar 12, the connecting bar 13, and the end bar 14 are arranged such that the wide surface of the bars is aligned vertically. Furthermore all bars are arranged in an upwardly extending or at least a horizontal direction radially pointing away from the bracket support 7, dependent on the size of the instrument to be received (FIG. 4).

The lower bar 11 is received at one end by the lower receiving means 9. The lower bar is then connected with the connecting bar 13 in the region of the contour 11*a*. The other end of the lower bar 11 is connected with the upper bar 12 in a medium portion. Therein, the face of the lower bar 11 facing the connecting bar 13 is a different face than that facing the upper bar 12 (FIG. 3).

The upper bar 12 is received by the upper receiving means 10 as described above. In a medium portion, the upper bar 12 is connected with the lower bar 11. On the same side as the one having the lower bar 11 connected, the end bar 14 is connected with the end of the upper bar 12 not facing the stand.

The end bar 14 is connected with the upper bar 12 at one end. In a medium portion the connecting bar 13 is arranged on a side different from the one on which the upper bar 12 is arranged. The end of the end bar 14 averted from the bracket support 7 is formed in a T-shape and forms a rest (not shown). Thus, a receiving part 15 can be arranged on an edge of the end bar 14 pointing upwardly.

In the preferred embodiment the bars are each riveted with one another. A rotation around the rivets remains possible. By changing the position of the lower bar support 9 along the bracket support 7 the size of the bracket changes due to the connection of the bars. In the present embodiment, the movement is achieved by a rotation of the fixing means 8. The lower bar support 9 therein is fixedly connected with the fixing means 8. In general, it can be said that the size of the bracket increases, when increasing the distance between the lower bar support 9 and the upper bar support 10, and decreases when decreasing the distance between the lower bar support 9 and the upper bar support 10.

By screwing the fixing means 8 into the thread portion 7*a* of the bracket support 7, a shear force is transmitted from the lower bar 11 to the upper bar 12. Due to leverage, the upper bar 12 is erected, and due to the connection with the lower bar 11, the lower bar 11 is also erected (FIG. 3). Thus, the inner angle at the lower bar 11, that is the acute angle between the lower bar 11 and the bracket support 7, becomes more acute. At the same time, the upper bar 12 exerts a pulling force onto the end bar 14, which therefore is pulled radially in direction of the bracket support 7. Thus, the size of the snare drum bracket decreases. The connecting bar 13 connects the lower bar 11 and the end bar 14 with one another. Due to the connecting bar 13 and the pivotable support of the end bar 14 with respect to the upper bar 12, the inclination of the end bar 14 is decoupled from the steep inner angle of the lower bar 11 with respect to the axis of the bracket support 7, and essentially remains constant throughout the changing of the inner angle. The inclination of the end bar 14 with respect to the horizontal in the following is denoted as the receiving angle, since, in the preferred embodiment, this corresponds to the angle by which the receiving part 15 receives a musical instrument. By the decoupling of the receiving angle from the inner angle, steeper inner angles and thus smaller bracket sizes can be realized, since the end bar 14 provides a flat rest also for small angles. This allows a reliable reception of a smaller instrument (FIG. 3).

As can be seen from FIG. 3, the inner angle can even be reduced so far that the lower bar 11 is arranged nearly perpendicular. An abutting of the lower bar against the receiving portion 10*a* of the upper bar support 10, as it is expected for minimal inner angles, is prevented by providing the contour 11*a* in the lower bar 11. As described above, the contour 11*a* therefore is formed such that it just protrudes around the receiving portion.

Screwing the fixing means 8 out of the thread portion 7*a* brings the lower bar support 9 in a lower position (FIG. 4). By doing this, the lower bar 11 exerts a pulling force onto the upper bar 12 pulling the latter downwards. The inner angle between the upper bar 12 and the bracket support 7 therefore becomes flatter. At the same time, due to leverage, the upper bar 12 pushes the portion of the lower bar 11 being connected with the upper bar 12 away from the bracket support 7 in a radial direction. The further the fixing means 8 are screwed out of the thread portion 7*a*, the flatter the inner angle between the lower bar 11 and the bracket support 7 thus becomes. In addition, the upper bar 12 exerts a shear force onto the end bar 14 in a radial direction away from the bracket support 7, and the bracket size is increased. Due to the connecting bar 13 connecting the lower bar 11 and the upper bar 14 and due to the pivotal support of the end bar 14 with respect to the upper bar 12, the receiving angle of the end bar 14 is decoupled from the inner angle of the lower bar 11 and essentially remains constant. The upper bar 12 can be tilted almost into a horizontal position. Thus, the bracket size is increased up to a maximum bracket size, without the receiving angle of the end bar 14 changing significantly. Thus, also bigger instruments can be received reliably.

FIG. 4 shows a snare drum bracket adjusted to receive a bigger instrument. Abutting of the lower bar 11 against the connecting bar 13, as it is expected for big inner angles, here is prevented by providing the contour 11*a* in the lower bar 11 and the step 13*a* in the connecting bar 13. As described above, the step 13*a* and the contour 11*a* therein are formed such that the connecting bar 13 and the lower bar 11 may be arranged almost form-fitted on top of each other.

The receiving parts 15 are arranged on the end bar 14 forming a flat rest throughout the entire possible interval of inner angles. A musical instrument can be inserted from the top into the receiving parts 15 or be enclosed by them. Screwing in of the fixing means 8 into the thread portion 7*a* causes a decrease in size of the snare drum bracket, and the instrument is fixedly clamped between the receiving parts 15. Taking out the instrument happens the other way around by releasing the fixing means 8. An adjustment of the individual bracket mounts or bars is not required for the use of the snare drum bracket 5 according to the invention, since the snare drum bracket 5 comprises a self-adjusting bracket size in the embodiment according to the invention. The size of the instruments to be used can vary in a wide interval of size, without the snare drum bracket 5 losing its functionality and reliability.

In a further embodiment, further bars may be formed to enable for an even bigger interval of angles. Further, the bars may comprise portions in which the rivets are slidable, thereby achieving a further variability of the bracket size.

Furthermore, it is possible for a further embodiment of the invention that the connection between the bars is not established by riveting, but rather for example by screwing.

It is also possible for a further embodiment, that the fixing means are not engaged with a thread, but for example rather are a thumb screw clamping the receiving means against the bracket support on a side.

Further, it is possible that the snare drum bracket is not mounted to its own stand with tripod, but for example it may be screwed directly to a table or be received by a stand together with other instruments.

It is also possible that the upper bar support is not arranged fixed in position, but rather comprising fixing means being coupled to the upper bar support for the latter's movement, or to both bar supports.

The invention claimed is:

1. A snare drum stand, comprising:

a snare drum bracket including a plurality of interconnected bars that are movably coupled to one another, the interconnected bars including each of an end bar and a lower bar, and the connecting angle of the interconnected bars being variable with respect to each other to define a plurality of snare drum bracket sizes; and wherein an inclination of the end bar is decoupled from an inner angle of the lower bar.

2. The snare drum stand according to claim 1, wherein the inclination of the end bar equals a receiving angle of a receiving part for receiving a snare drum.

3. The snare drum stand according to claim 2, further comprising a lower bar support and an upper bar support each supporting a plurality of the interconnected bars, and the upper and the lower bar supports being arranged at a bracket support.

4. A snare drum stand, comprising:

a snare drum bracket including a plurality of interconnected bars that are movably coupled to one another, the interconnected bars including each of an end bar and a lower bar, and the connecting angle of the interconnected bars being variable with respect to each other to define a plurality of snare drum bracket sizes, wherein an inclination of the end bar is decoupled from an inner angle of the lower bar, and wherein the inclination of the end bar equals a receiving angle of a receiving part for receiving a snare drum;

further comprising a lower bar support and an upper bar support each supporting a plurality of the interconnected bars, and the upper and the lower bar supports being arranged at a bracket support, wherein the interconnecting bars include a connecting bar, and wherein further the lower bar is connected to each of the lower bar support, the upper bar and the connecting bar.

5. The snare drum stand according to claim 4, wherein the end bar is connected to the connecting bar.

6. The snare drum stand according to claim 5, wherein the upper bar is connected with the upper bar support and the end bar.

7. The snare drum stand according to claim 6, wherein the connections between the bars and the connections with the bar supports are pivotally formed.

8. The snare drum stand according to claim 7, wherein the connections between the bars and the connections with the bar supports are pivotally riveted to each other.

9. A snare drum stand, comprising:

a snare drum bracket including a plurality of interconnected bars that are movably coupled to one another, the interconnected bars including each of an end bar and a lower bar, and the connecting angle of the interconnected bars being variable with respect to each other to define a plurality of snare drum bracket sizes, wherein an inclination of the end bar is decoupled from an inner angle of the lower bar, and wherein the inclination of the end bar equals a receiving angle of a receiving part for receiving a snare drum;

further comprising a lower bar support and an upper bar support each supporting a plurality of the interconnected bars, and the upper and the lower bar supports being arranged at a bracket support, wherein the snare drum bracket size is variable by varying the distance between the bar supports along the bracket support.

10. The snare drum stand according to claim 9, wherein for maximum snare drum bracket size the upper bar is adjustable up to a horizontal position by adjusting a maximum distance of the bar supports with respect to each other.

11. The snare drum stand according to claim 10, wherein at least one of the bar supports is fixable by means of fixing means.

12. The snare drum stand according to claim 11, wherein at least one of the bar supports is pivotally coupled to the fixing means.

13. The snare drum stand according to claim 12, wherein the bracket support comprises a thread portion.

14. The snare drum stand according to claim 13, wherein the fixing means are formed as a screw nut.

15. The snare drum stand according to claim 14, wherein the screw nut is engaged with the thread portion and movable by thread rotation along the bracket support.

16. The snare drum stand according to claim 15, wherein the interconnecting bars include a connecting bar, and wherein further the lower bar is connected to each of the lower bar support, the upper bar and the connecting bar.

17. The snare drum stand according to claim 16, wherein the end bar is connected to the connecting bar.

18. The snare drum stand according to claim 17, wherein the upper bar is connected with the upper bar support and the end bar.

19. The snare drum stand according to claim 18, wherein the connections between the bars and the connections with the bar supports are pivotally formed.

20. The snare drum stand according to claim 19, wherein the connections between the bars and the connectins with the bar supports are pivotally riveted to each other.

* * * * *